United States Patent [19]

Bossetti

[11] 4,340,358

[45] Jul. 20, 1982

[54] APPARATUS AND PROCESS FOR DISCHARGING TILES FROM HIGH SPEED OVENS FOR THE PRODUCTION OF TILES

[75] Inventor: Renato Bossetti, Novara, Italy

[73] Assignee: Societa Impianti Termoelettrici Industriali (s.a.s.), Novara, Italy

[21] Appl. No.: 166,812

[22] Filed: Jul. 8, 1980

Related U.S. Application Data

[63] Continuation-in-part of Ser. No. 155,114, May 30, 1980, abandoned, which is a continuation of Ser. No. 929,292, Jul. 28, 1978, abandoned.

[30] Foreign Application Priority Data

Jul. 28, 1977 [IT] Italy ..... 26234 A/77

[51] Int. Cl.[3] ..... F27D 3/00; F27B 9/00

[52] U.S. Cl. ..... 432/11

[58] Field of Search ..... 432/11, 121, 239; 198/424, 425, 426

[56] References Cited

U.S. PATENT DOCUMENTS 3,529,711 9/1970 Mueller ..... 198/424

3,854,569 12/1974 Steinhart et al. ..... 198/424

3,970,189 7/1976 Steinhart ..... 198/425

4,105,398 8/1978 Disch et al. ..... 432/121

*Primary Examiner*—John J. Camby

*Attorney, Agent, or Firm*—Wenderoth, Lind & Ponack

[57] ABSTRACT

A process is described according to which tiles are taken up from the oven in which they have been fired, are accelerated to space them from one another, and then are further accelerated and brought into alignment in a direction transverse to that of travel, and are finally discharged onto a terminal conveyor. The apparatus for carrying out the process comprises, in combination with each firing oven chamber and with a terminal conveyor, a first conveyor for taking up the tiles from the oven, a second conveyor for accelerating them, a third conveyor for ejecting the tiles onto the terminal conveyor, and means for aligning the tiles with respect to the direction of travel of this latter before they leave the ejecting conveyor. The speeds on the accelerating conveyor and on the ejecting conveyor for high speed ovens, are respectively 1.8 to 2.2 times and three to five times the linear speed of the tiles in the oven.

11 Claims, 2 Drawing Figures

APPARATUS AND PROCESS FOR DISCHARGING TILES FROM HIGH SPEED OVENS FOR THE PRODUCTION OF TILES

This application is a continuation in part of application Ser. No. 155,114 which was filed May 30, 1980, now abandoned, which is a continuation of application Ser. No. 929,292 which was filed July 28, 1978 and which is now abandoned.

BACKGROUND OF THE INVENTION

The present invention relates to a device for the discharge of tiles from treatment and firing ovens, particularly ovens constituted by elongated processing chambers along which the tiles are caused to travel by supporting and advancing devices, especially rollers. An oven of such a type is described in copending application Ser. No. 835,013 filed on Sept. 20, 1977, now U.S. Pat. No. 4,154,576, to which reference is made herein purely for illustrative purposes but without intending to limit thereby the invention and its application to ovens as described and claimed in such application.

Further, the invention is particularly applicable to ovens having a plurality of superimposed channels, such as those described in the aforesaid application and in other applications, or possibly having channels set side-by-side or channels that are superimposed and set side-by-side. But since the tiles travel independently in each of such channels and must be independently discharged therefrom, the apparatus and the devices according to the invention will be described essentially by referring to a single channel and a single tile treatment and firing plane, it being clear that they may be repeated for any number of channels or planes or treatment or firing chambers.

The invention is particularly useful in connection with modern high speed ovens of the type described, i.e. ovens in which the linear speed of the tiles is not less than 1 meter and preferably from 1 to 1.5 meter per minute.

The Prior Art

Processes and apparatus for discharging workpieces from various processing apparatus, by means of conveyors, e.g. roller or belt conveyors, are known. Specifically, it is known, e.g. from U.S. Pat. No. 4,105,398, successively to accelerate workpieces issuing from a furnace for the purpose of aligning them longitudinally between two initially converging and subsequently parallel guides. The accelerations have then the purpose of longitudinally distancing workpieces which have travelled through the furnace more or less side-by-side and which otherwise could not become longitudinally aligned.

When a result opposite to that of U.S. Pat. No. 4,105,398 is to be achieved, namely the workpieces are not to be longitudinally spaced apart and aligned but it is wished to bunch them together, it is known, e.g. from U.S. Pat. No. 3,529,711, to employ a stop bar.

In the device described by said patent, the workpieces are conveyed by a belt, come up against a stop bar, are temporarily stopped thereby and bunched together, and only subsequently are accelerated by a second belt in their bunched-up disposition, to facilitate their transfer onto a further belt running at right angles to the preceding ones.

It is also known from British Specification 1,168,589 to provide, in an apparatus for delivering candy bars for wrapping, an accelerating belt and a stop bar so disposed that the bars are accelerated before coming into engagement with the stop bar, and not thereafter as in cited in U.S. Pat. No. 3,529,711. The acceleration, the degree of which is not specified in the British Specification, has the purpose of allowing sufficient time for the stop bar transversely to align the candy bars to form transverse rows bunching-up of the succesive rows. The aligned rows are picked up by a belt running at right angles to the preceding one, raised to a higher level, and converted to wrapping means.

Attempts to adopt the means described in the aforesaid patents for the discharge of tiles from firing ovens, particularly high speed ones, do not furnish acceptable results and indeed make the orderly discharge of the tiles impossible. The tiles are loaded into the oven in transversely aligned rows, successive rows being spaced longitudinally apart to an extent that is moderate enough not to lower the production and the efficiency of the oven. No matter how perfect the inner conveyors of the oven, the rows become somewhat disarranged as they travel along the oven, which is some tens of meters long. When they issue from the oven, perfect transverse alignment must be re-established without slowing down the operation and while absolutely avoiding any danger of bunching-up or of contact between travelling tiles and particularly between tiles belonging to successive rows. It is therefore obvious that neither the longitudinal alignment provided by U.S. Pat. No. 4,105,398, nor the bunching-up provided by U.S. Pat. No. 3,529,711, can be adopted. At first sight it would seem that the method of the British Specification would solve the problem, since it provides transverse alignment without bunching-up. Experience, however, has taught that in connection with firing ovens for tiles, and particularly high speed ones, such method does not work. It is found that the time required for all the tiles of one transverse row to come into engagement with a stop bar, is long enough to cause disorderly contact between tiles of successive rows, and hence the breakdown of all the operation downstream of the oven. If it is attempted to overcome this drawback by increasing the acceleration between the oven and the accelerating conveyor in order to increase the spacing between successive tile rows, it is found that the drawback, far from disappearing, becomes more severe, because the increased speed increases the misalignment of the tiles and therefore the time required for the stop bar to align them, to an extent that is greater than the extent by which the spacing between successive rows is increased. Furthermore, it is found that if the acceleration is excessive, or if increased speed is maintained for too long a period of time, the tiles tend to rotate and to become set at sharp angles to the direction of travel, and re-alignment becomes practically impossible. In modern high speed ovens, these problems are particularly severe and the process conditions particularly critical.

SUMMARY OF THE INVENTION

The inventor has surprisingly found that the aforesaid problem can be solved by combining an acceleration of the tiles, within specific limits, and a successive alignment by means of a stop bar, with a second acceleration, also within specified limits, interposed between the first acceleration and the engagement of the tiles with the stop bar. The degrees of the two accelerations are critical. More precisely, while the first acceleration, i.e. the ratio of the speed imparted by the second accelerating conveyor to the speed with which the oven delivers the tiles, may range from a minimum of 1.8 to a maximum of 3, in high speed ovens it must be in the narrow range of from 1.8 to 2.2. The final acceleration, i.e. the ratio of the speed imparted by the second accelerating conveyor to the speed with which the oven delivers the tiles, may be as high as 8–9, but in high speed ovens the range is from 3 to 5.

The process according to the invention, therefore, comprises the steps of taking up the tiles at the linear longitudinal speed which they have in the oven chamber, subjecting them to a first acceleration, subjecting them to a second acceleration, stopping them with their leading edges in transversal alignment, preferably substantially immediately after applying the second acceleration, and subsequently releasing them and discharging them, in their acquired transversely aligned formation, at the speed defined by the second acceleration.

The expression "substantially immediately after applying the second acceleration" is to be understood as having the following meaning. When a tile is accelerated, the higher speed is firstly imparted to its leading portion, since for a certain interval of time the leading portion of the tile is in engagement with the downstream faster conveyor and is actuated thereby, while the trailing portion is still in engagement with the upstream, slower conveyor. A certain amount of slippage will occur under these circumstances. The tile is considered as being completely accelerated when all its portions are in engagement with the faster conveyor and are actuated at the accelerated speed. According to the invention, once this condition is reached, or very shortly thereafter, the tile is stopped. In other words, the tile does not travel with all its portions actuated at the finally accelerated speed, for any considerable period of time before it is stopped for aligning. In still other words, the final, highest speed completely obtains substantially only during the aligning phase.

This situation, of course, will prevail to a greater or smaller degree depending on the size of the tiles. Tiles of the greatest length which the apparatus can accomodate, will be stopped almost immediately after the second acceleration, while smaller tiles will have to travel by the distance necessary to bring them into contact with the element which stops them, all such cases are intended to be comprised in the expression "substantially immediately after applying the second acceleration".

For the sake of brevity, the acceleration ratio of the final, highest speed to that which the tiles have in the oven, will be called "final acceleration ratio" or, briefly, "final acceleration".

In the preferred embodiment of the invention, adapted for use in connection with high speed ovens, the first acceleration ratio is 1.8–2.2 and the final acceleration ratio is 3–5.

Optionally, the tiles may be periodically stopped, e.g. during the alignment phase, at points of their travel other than the alignment zone by using auxiliary retaining bars and/or by temporarily stopping a conveyor.

The apparatus which forms the object of the invention is characterized in that it comprises, in combination with each tile processing and firing chamber along which the tiles travel parallel to the longitudinal axis of the chamber with a linear processing speed, and with a conveyor for taking up the fired tiles and conveying them to any suitable transport and/or storage device, a first, receiving conveyor device for taking up the fired tiles from the oven chamber and advancing the same in the same direction and substantially with the same speed which they have in the processing chamber; a second conveyor device called an "accelerating conveyor" following the first receiving conveyor, for receiving the tiles from the receiving device and advancing them at a speed greater than that which they have in the receiving device; a third conveyor device called an "ejecting conveyor" for receiving the tiles from the accelerating conveyor and discharging them onto the take-up conveyor with a speed greater than that which they have in the accelerating conveyor, and retaining means for temporarily stopping the tiles and determining their transversal alignment, before they leave the ejecting conveyor. Preferably the speed of the accelerating conveyor is 1.8–2.2 times the speed of the receiving conveyor, and the speed of the ejecting conveyor is 3–5 times the speed of the receiving conveyor.

Optionally, the apparatus according to the invention may comprise means for retaining the tiles on the accelerating conveyor and permitting their passing to the ejecting conveyor only in a predetermined phase of the discharge operations and particularly when the ejecting conveyor has discharged all the tiles which are located thereon onto the take-up conveyor, or at least is in a phase of sufficiently advantaged discharge; or it may comprise means for temporarily stopping, the accelerating conveyor. It should be understood that the expressions "processing chamber" or "treatment or firing oven", include that part of the apparatus in which the tiles cool down. In other words, the apparatus according to the invention does not necessarily receive the tiles from a closed apparatus such as an oven, but may receive them from any conveyor located downstream of the oven and on which the tiles travel, generally to complete the cooling down, even in the open air.

BRIEF DESCRIPTION OF THE DRAWINGS

The invention will be better understood from the description of an illustrative and not limitative embodiment thereof, with reference to the appended drawings, wherein.

DETAILED DESCRIPTION OF THE INVENTION

Since, as has been said, each plane or channel or processing chamber of the oven will generally be provided with its own discharge apparatus, the present description and drawings illustrate an apparatus which cooperates with one oven plane or chamber only, it being understood that in the case of a multiple plane oven the apparatus described herein will be repeated for every oven plane. Correspondingly, the drawings illustrate a single plane of the apparatus, which in a multiple plane oven could be an intermediate plane, but the apparatus would be the same if it were the uppermost or the lowermost plane or, as the case may be, the only plane.

With reference to the figures, now, numeral 10 generally designates a frame of the apparatus which may have any convenient structure, and which supports three conveyor devices which are illustrated as being, in this case, roller conveyors, but which would also have a different structure. The frame is illustrated only insofar as it relates to the oven plane under consideration, and is vertically interrupted, and can extend downwards or upwards to service different oven planes. The conveyor devices are three, as has been said, and are generally indicated at 11, 12 and 13, and will be called respectively the tile receiving conveyor, the tile accelerating conveyor and the tile ejecting conveyor.

Figure 1:
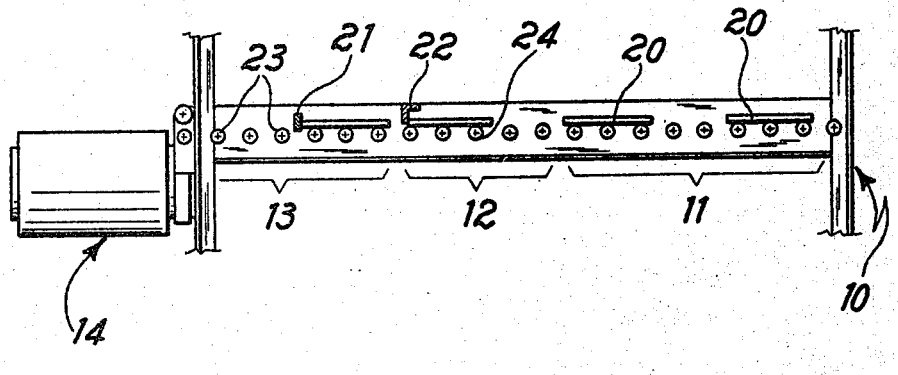
FIG. 1 illustrates in schematic vertical cross-section, on a plane parallel to the longitudinal axis of the oven, a discharge apparatus according to an embodiment of the invention.
Figure 2:
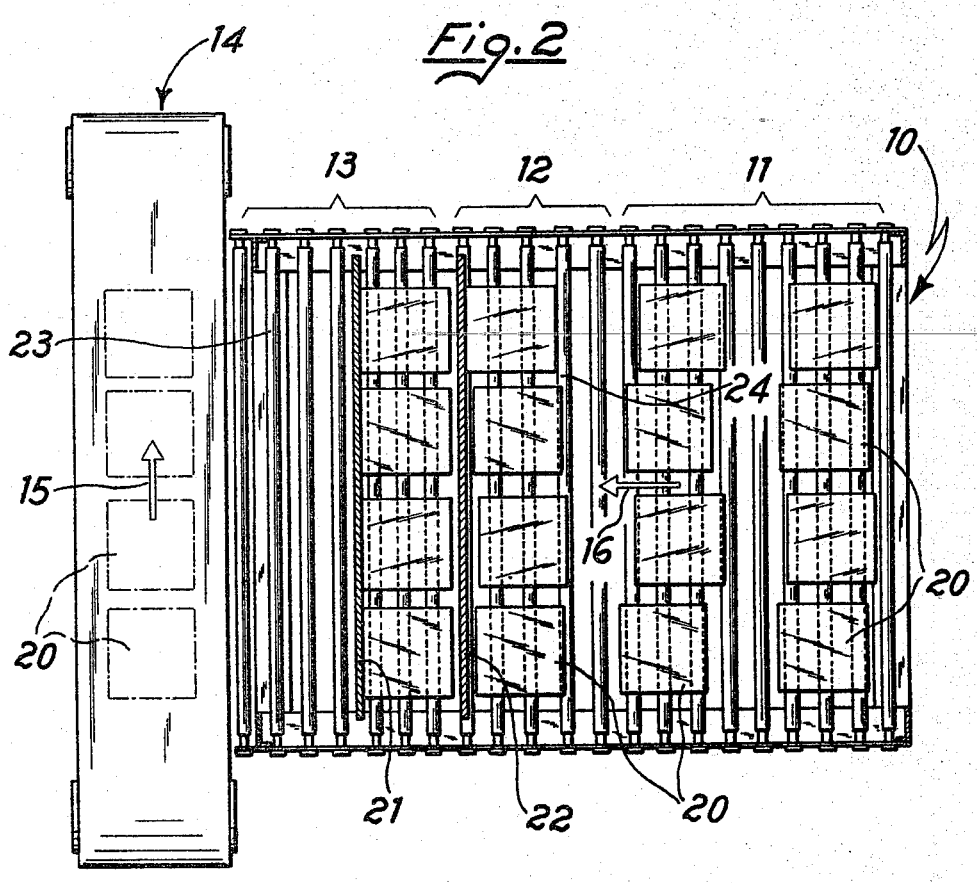
FIG. 2 illustrates in plan view the same apparatus of FIG. 1.

A take-up conveyor 14 is located at the tail end of the apparatus, and its direction of travel is indicated by arrow 15 in FIG. 2, as it is seen, but it could be reversed and anyway is substantially perpendicular to the direction of travel, indicated by arrow 16, of the tiles in the device of the apparatus according to the invention, which is generally parallel to the direction of travel in the oven. The main task of the apparatus herein described is to receive the tiles from the oven (or from the conveyors which follow the oven and which, as has been said, are considered as part of the oven for the purposes of this invention) and to discharge them onto the conveyor 14 in suitably aligned condition so that they may proceed from conveyor 14 to other conveyors and/or to storage devices which are not described but which may be of any kind.

The receiving roller conveyor 11 then, receives the tiles 20, only a limited number of which are shown for illustrative purposes, from the oven, and advances them in the direction of arrow 16 at the same speed which they have in the oven. A certain acceleration would be permissible here, but is has not advantages and in general will not exist.

The tiles pass from the receiving conveyor 11 to the accelerating conveyor 12 the speed of travel of which is significantly higher, e.g. up to three times that of the conveyor 11, but critically, for high speed ovens, from 1.8 to 2.2 times. This causes the rows of tiles to become longitudinally spaced from one another.

Thereafter, the tiles pass from the accelerating conveyor 12 to the ejecting conveyor 13 which has a speed which is considerably higher than that of the device 12 and, e.g., can be as high as eight to nine times, but for high speed ovens is critically from three to five times the speed of the receiving conveyor 11. The tiles which reach conveyor 13, however, cannot advance freely because they are retained by an alignment element essentially having the form of a stop bar 21 extending transversly to the direction of travel of the tiles. Consequently the tiles become aligned along the retaining element 21. It is to be noted that, for reasons well known to persons skilled in the art, the tiles generally do not arrive from the oven in perfectly aligned relationship, because no matter how perfect the oven advancing devices may be, there is always a certain, sometimes a considerable, irregularity in the motion of the tiles and they never proceed exactly side by side. However thanks to the element 21 against which they are urged by the ejecting device, they become exactly aligned. Once the transverse alignment is complete, which occurs in an empirically determined period of time, the element 21 is removed, either by lowering or by raising but preferably by lowering, by means of mechanical devices which need not be described as they may be conventional, and now the tiles which have stopped in the first portion of the conveyor 13, travel all the way through conveyor 13 and are ejected in perfectly aligned relationship onto the conveyor 14 which carries them to their destination.

The complete cycle of motion of bar 21, i.e. the sum of the times it remains in operative and in the inoperative positions and of the times required for passing from the first to second position, and vice versa, is equal to the time required for one row of tiles to take the place of the second on conveyor 13 (the linear distance between rows divided by the linear speed of the conveyor) and depends therefore not only on the linear speed of the conveyor 13 but also on the distance between successive rows of tiles in the various parts of the apparatus.

The drawings represent a phase of the process during which the retaining bar 21 is operative. Four rows of tiles are shown in the drawings. The first two rows from the right, i.e. those closest to the oven, are in engagement with the receiving conveyor 11; the second row is in engagement with the accelerating conveyor 12; and the third row, with the ejecting conveyor 13 and with the retaining element or stop bar 21. An inspection of the drawings will show that the tiles of the last row are in engagement with all the rollers 23 of the ejecting conveyor 13 that are located upstream of the aligning element 21. This means that substantially as soon as the tiles have ceased to be in engagement with the accelerating conveyor 12 and all their portions, including the trailing portion, have engaged the ejecting conveyor 13, such tiles are engaged by the retaining element 21; or, in other words, they do not travel for any substantial length of time with all their portions in engagement with the fastest conveyor, before being stopped for alignment. This situation prevails when the tiles are, as shown in the drawings, the longest which the apparatus can accomodate. If they are shorter, obviously they will not contact one or more of the rearmost rollers 23 when they are in engagement with retaining element 21, and will have to travel some distance to come into engagement therewith.

The optimal acceleration ratios depend on the material and structure of the tiles. The absolute speeds depends on the firing speeds, which are generally smaller for the larger tiles. For example, when the linear speed of the tiles in the oven is 1 mt/h, the speed on the accelerating and ejecting conveyors will be 1.8 to 2.2 and 3 to 5 mt/min respectively; while if the oven speed is 1.5 mt/min, the aforesaid speeds will be 2.7 to 3.3 and 4.5 to 7.5 mt/min respectively.

Rollers 24 of the accelerating conveyor may be stopped during the alignment phase, but this is not necessary. An additional optional device, generally not necessary, is constituted by an auxiliary retaining element 22, which may have the form of a bar, e.g. an angle bar, as illustrated in the drawings, and which has to and fro motion caused by any conventional mechanism, and in its lowermost position presses against the tiles and retains them on the accelerating conveyor. When bar 22 is its retaining position, the rollers 24 of the accelerating conveyor 12 may be stopped.

The synchronization of the devices should be such that once the last file of tiles has been discharged from the ejecting conveyor, the aligning element 21 immediately moves downwards up upwards to stop the tiles which will arrive next and once a new file of tiles has formed against element 21, the auxiliary retaining device 22—if it exists—immediately moves downwards to retain the next subsequent tiles. In general this may be achieved through suitably predetermined synchronization and choice of speeds, but photoelectric cells may be used, if desired, at least for safety purposes.

The differences in speed between the receiving, accelerating and ejecting conveyors are such that normally the first conveyor continues to operate and to feed tiles forwards towards the second, and no disadvantage derives therefrom.

It is not necessary to describe the specific devices which actuate the various parts of apparatus, i.e. the roller and alignment and retaining bar control mechanisms, nor the means for their synchronization, since such devices are known per se and are easily designed by a person skilled in the art.

The invention solves in a simple and perfect manner a problem hitherto not solved, i.e. the problem of transferring the tiles which come out of the oven in a relatively disordered manner, to a conveyor on which they must be disposed in perfectly transversely aligned groups for suitable storage and transport.

A specific embodiment has been described for illustrative purposes, but the invention may be carried into practice with many modifications and variations and adaptations without exceeding its scope.

I claim:

1. A process for discharging fired tiles from firing ovens or devices and/or conveyors located downstream thereof, said process comprising:

receiving plural generally transverse rows of said fired tiles at a first speed substantially equal to the travel speed of said tiles in an oven chamber, and conveying each said row of tiles at said first speed and in a direction of travel;

increasing the speed of each said row of tiles to a second speed greater than said first speed, and thereby increasing the spacing between successive said rows of tiles, and conveying each said row of tiles at said second speed and in said direction of travel;

subsequently further increasing the speed of each said row of tiles to a third speed greater than said second speed, and bringing each said row of tiles into engagement with an aligning device and thereby precisely aligning said row in a direction transverse to said direction of travel;

subsequently discharging the thus aligned row of tiles at said third speed onto a discharge conveyor and conveying them to transport and/or storage devices.

2. A process as claimed in claim 1, comprising bringing said tiles into engagement with said aligning device substantially immediately after said step of further increasing said speed.

3. A process as claimed in claim 1, wherein the ratio of said second speed to said first speed is in the range of from 1.8 to 2.2, and the ratio of said third speed to said first speed is in the range of from three to five.

4. A process as claimed in claim 1, further comprising stopping conveying those tiles being conveyed at said second speed until said aligned row of tiles have been disengaged from said aligning device and are being discharged onto said discharge conveyor.

5. A process as claimed in claim 1, further comprising stopping conveying those tiles being conveyed at said second speed while those which have been subjected to said step of further increasing are in engagement with said aligning device.

6. In a system including an oven, such as a multiple plane and/or multiple chamber oven, for the production of tiles, wherein from each of a plurality of tile treatment and firing chambers, and optionally from each of a plurality of cooling and/or conveying devices downstream of said chambers, fired tiles are discharged and travel in plural rows in a direction parallel to the longitudinal axes of said chambers at a linear processing speed, and a take-up conveyor for taking up the fired tiles and conveying them to any suitable transport and/or storage device, the improvement of a discharge device for transferring said fired tiles from said chambers or said cooling and/or conveying devices to said take-up conveyor, said discharge device comprising:

first roller conveyor means for receiving said plural rows of fired tiles from said oven chambers or from devices located downstream thereof, and for advancing said fired tiles in said direction at a first speed substantially equal to said linear processing speed;

second roller conveyor means for receiving said plural rows of fired tiles from said first roller conveyor means, and for advancing said fired tiles in said direction at a second speed greater than said first speed;

third roller conveyor means for receiving said plural row of fired tiles from said second roller conveyor means, and for advancing said fired tiles and discharging said fired tiles row-by-row onto said take-up conveyor at a third speed greater than said second speed;

means, extending transversely of said direction, for stopping each said row of fired tiles while on said third roller conveyor means, and for thereby precisely transversely aligning said row before discharge of said row to said take-up conveyor.

7. The improvement claimed in claim 6, further comprising retaining means, extending transversely of said direction, for blocking movement of those fired tiles on said second rolling conveyor means and for preventing them from passing to said third roller conveyor means until said third roller conveyor means is in condition to receive them.

8. The improvement claimed in claim 7, wherein said retaining means comprises a blocking element extending in a straight line perpendicularly to said direction of travel of said fired tiles, said blocking element having at least a vertical dimension and being mounted for movement from a higher inactive position to a lower position whereat it blocks said fired tiles from moving from said second roller conveyor means.

9. The improvement claimed in claim 8, wherein when said blocking element is in said lower position, said second roller conveyor means is stopped.

10. The improvement claimed in claim 6, wherein said aligning means is displaceable from a blocking position to align said fired tiles in a direction having at least a vertical component to a position to allow said fired tiles to freely advance once they have been aligned.

11. The improvement claimed in claim 6, wherein said second speed is from 1.8 to 2.2 times said first speed, and said third speed is from three to five times said first speed.

* * * * *